US008628138B2

(12) United States Patent
Siegert

(10) Patent No.: US 8,628,138 B2
(45) Date of Patent: Jan. 14, 2014

(54) DRAWER-TYPE COOLING BOX

(75) Inventor: Thomas Siegert, Rheda-Wiedenbrück (DE)

(73) Assignee: Mobil Invest GmbH, Hannover (DE)

( * ) Notice: Subject to any disclaimer, the term of this patent is extended or adjusted under 35 U.S.C. 154(b) by 87 days.

(21) Appl. No.: 13/293,364

(22) Filed: Nov. 10, 2011

(65) Prior Publication Data

US 2012/0112613 A1 May 10, 2012

(30) Foreign Application Priority Data

Nov. 10, 2010 (DE) ..... 10 2010 050 787
Mar. 31, 2011 (DE) ..... 10 2011 015 665

(51) Int. Cl.
*B60P 1/00* (2006.01)

(52) U.S. Cl.
USPC ..... 296/156

(58) Field of Classification Search
USPC ..... 296/156, 37.6, 100.02; 222/129.1, 131, 222/146.6, 53.8; 126/21 A; 36/724; 62/133, 62/243, 440, 382, 448; 312/236, 330.1, 312/401, 404
See application file for complete search history.

(56) References Cited

U.S. PATENT DOCUMENTS 4,238,934 A * 12/1980 Hotta ..... 62/457.2
4,319,629 A * 3/1982 Hotta ..... 165/47
4,898,294 A * 2/1990 Jennings ..... 220/592.09
4,961,322 A * 10/1990 Oguma et al. ..... 62/179
5,460,441 A * 10/1995 Hastings et al. ..... 312/298
5,829,130 A * 11/1998 Miller ..... 29/868
5,848,534 A * 12/1998 Stauffer ..... 62/91
5,850,296 A * 12/1998 Wang et al. ..... 358/474
6,021,047 A * 2/2000 Lopez et al. ..... 361/727
6,237,765 B1 * 5/2001 Hagen et al. ..... 206/315.11
6,305,185 B1 * 10/2001 Sloan ..... 62/457.7
6,354,104 B1 * 3/2002 Feagin ..... 62/457.1
6,763,676 B2 * 7/2004 Jones et al. ..... 62/392
6,971,730 B2 * 12/2005 Koons ..... 312/404
7,310,967 B2 * 12/2007 Aragon ..... 62/371
7,345,264 B2 * 3/2008 Yoshidome ..... 219/756
7,536,868 B1 * 5/2009 Ward ..... 62/237
7,537,003 B2 * 5/2009 Iwamoto ..... 126/299 R (Continued)

FOREIGN PATENT DOCUMENTS

DE 8909402 U1 9/1989
DE 298 06 936 U1 6/1998
DE 112006000823 T5 2/2008
DE 102007043213 A1 3/2008

*Primary Examiner* — Kiran B Patel
(74) *Attorney, Agent, or Firm* — Laurence A. Greenberg; Werner H. Stemer; Ralph E. Locher

(57) ABSTRACT

A drawer-type cooling box assembly includes a cooling box which is mounted in a housing, in particular in a kitchen unit of a camping vehicle, so as to be able to be pulled out and pushed in on pull-out guides and has an upwardly directed access opening and an upper cooling box covering. The drawer-type cooling box is able to be operated very much more easily and significantly improving the accessibility to foodstuffs stored in the drawer-type cooling box, which is obtained in that the cooling box covering is mounted movably in the kitchen unit via coupling elements, is lifted off upward from the cooling box in a pulled-out position of same and, in a pushed-in position, is lowered downward onto the access opening of the cooling box.

7 Claims, 2 Drawing Sheets

(56) References Cited

U.S. PATENT DOCUMENTS

| | | | | |
|---|---|---|---|---|
| 7,861,458 | B2 * | 1/2011 | Apps et al. | 43/105 |
| 7,861,892 | B1 * | 1/2011 | White et al. | 222/108 |
| 8,147,013 | B2 * | 4/2012 | Park | 312/402 |
| 8,220,886 | B2 * | 7/2012 | Han et al. | 312/402 |
| 8,291,816 | B2 * | 10/2012 | Iwamoto et al. | 99/467 |
| 2006/0288729 | A1 * | 12/2006 | Arjomand | 62/441 |
| 2007/0273256 | A1 * | 11/2007 | Martin et al. | 312/223.6 |
| 2008/0218038 | A1 * | 9/2008 | Wood et al. | 312/116 |
| 2008/0314067 | A1 * | 12/2008 | Lee | 62/441 |
| 2009/0199587 | A1 | 8/2009 | Matthews et al. | |
| 2009/0261698 | A1 * | 10/2009 | Cabal Velarde et al. | 312/334.8 |
| 2010/0200563 | A1 * | 8/2010 | Yoshidome | 219/399 |
| 2012/0255322 | A1 * | 10/2012 | Han et al. | 62/441 |

* cited by examiner

DRAWER-TYPE COOLING BOX

CROSS-REFERENCE TO RELATED APPLICATION

This application claims the priority, under 35 U.S.C. §119, of German application Nos. DE 10 2010 050 787, filed Nov. 10, 2010, and DE 10 2011 015 665, filed Mar. 31, 2011; the prior applications are herewith incorporated by reference in their entireties.

BACKGROUND OF THE INVENTION

Field of the Invention

The invention relates to a drawer-type cooling box containing a cooling box which is mounted in a housing, in particular in a kitchen unit of a camping vehicle, so as to be able to be pulled out and pushed in on pull-out guides and has an upwardly directed access opening and an upper cooling box covering.

A cooling drawer, in particular for furniture containing drawers, is known from, German utility model DE 29806936 U1, the cooling drawer having a heat-insulating hinged lid and recessed grips, which are accessible from the outside, in the hinged lid.

A disadvantage of the known cooling drawer is that it can only be operated with two hands, since the drawer has to be pulled open with one hand and the lid has to be raised with the other hand in order to place food to be cooled into the drawer or to remove cooled food therefrom. In addition, a cooling drawer of this type is relatively small and shallow and has only a little usable internal volume, which is also not completely accessible, since the lid can also only be partially lifted off.

SUMMARY OF THE INVENTION

It is accordingly an object of the invention to provide a drawer-type cooling box which overcomes the above-mentioned disadvantages of the prior art devices of this general type, which can be operated much more easily. Furthermore, the accessibility of foodstuffs stored in the drawer-type cooling box is intended to be significantly improved.

With the foregoing and other objects in view there is provided, in accordance with the invention a drawer-type cooling box assembly. The drawer-type cooling box assembly containing a housing for a kitchen unit of a camping vehicle, pull-out guides, coupling elements, and a cooling box mounted in the housing, so as to be able to be pulled out and pushed in on the pull-out guides and having an upwardly directed access opening and an upper cooling box covering. The cooling box covering mounted movably in the housing via the coupling elements, is lifted off upward from the cooling box in a pulled-out position of the cooling box and, in a pushed-in position, the cooling box is lowered downward onto the access opening of the cooling box.

According to the invention, the object is achieved with the characterizing features thereof in particular in that the cooling box covering is mounted in a fixed position but movable in a kitchen unit via coupling elements such that, in a pulled-out position of the cooling box remaining within the kitchen unit, the cooling box covering is lifted off upward from the cooling box and, in a pushed-in position, is lowered downward onto the upwardly directed access opening of the cooling box.

By the design being in the form of a drawer-type cooling box, first of all a much larger volume can be realized by comparison to a cooling drawer, in particular a deeper box can be formed, which box, owing to the deeper construction, also results in more economical operation, since the cooled air cannot escape so rapidly from the deep box as from the shallow drawer according to the prior art. Furthermore, this construction permits the realization of as large an access opening as possible, since the lid does not partially remain on the cooling drawer but rather is entirely lifted off from the drawer-type cooling box and, moreover, remains entirely within the kitchen unit.

In order to operate the drawer-type cooling box, only one maneuver is still required, and therefore the second hand can immediately gain access to the cooled material, thus substantially simplifying and accelerating the removal or the filling operation, and therefore, overall, even less heat or cold is output to the surroundings, as a result of which the efficiency of the drawer-type cooling box according to the invention is further improved.

According to a particularly preferred embodiment of the subject matter of the invention, the coupling elements consist of double-jointed levers which are arranged in pairs and on both sides of the cooling box covering and have horizontal axes of rotation at right angles to the pull-out direction such that, when the cooling box is pulled out, the cooling box covering can pivot upward about the positionally fixed axes of rotation of the double-jointed levers, and the cooling box can be pulled, fully opened, out of the kitchen unit.

The coupling elements are each preferably provided with the same length dimensions, and therefore a parallel movement of the cooling box covering in relation to the upper edge of the access opening of the cooling box is obtained. By this means, unnecessary relative movements between the access opening and the cooling box covering and the sealing surfaces involved are very substantially avoided, which contributes to the durability thereof.

According to a particularly advantageous embodiment of the invention, spring elements which are arranged elastically on one or both sides are provided between the cooling box covering and a part of the kitchen unit which is located thereabove and is fixed to the housing. The spring elements pull the cooling box covering permanently upward with an elastically pretensioned spring force. Owing to the fact that that side of the cooling box covering which is opposite to the pull-out direction is assigned at least one downwardly extending driver against which the rear inner end side of the cooling box presses at least from a virtually completely closed position as far as the closed position, the cooling box covering is lowered in parallel downward about the axes of rotation of the coupling elements onto the access opening of the cooling box counter to the spring force and is kept there.

A mechanically functionally reliable lowering of the cooling box covering is thereby provided in a very simple manner.

In order to further improve the accessibility of the drawer-type cooling box, it is integrated in the housing of a kitchen unit in such a manner that it can be pulled out to the left or right, as seen from the front side thereof such that, at least in a pulled-out position and in an arrangement of the housing of the kitchen unit in the region of a side door of a camping vehicle, the cooling box can protrude beyond the free door opening in the vehicle and is thus accessible from within and also from outside the vehicle. This affords an enormous advantage during use, since it is unnecessary to go specially into a vehicle for desired access into the cooling box when outside the vehicle. In this case, the kitchen unit can either be arranged in the longitudinal direction of a vehicle or else transversely with respect to the driving direction, for example behind the front seats of a camping vehicle, wherein the kitchen unit of course, then has to be installed in such a manner that, even when the doors are closed, there has to be sufficient clearance in order still to be able to pull out the cooling box laterally.

An advantageous development of the invention has drivers for the cooling box covering which, when the cooling function is not in use, can be placed mechanically, electrically and/or electromagnetically out of operation such that the currentless cooling box is then permanently ventilated, thus ensuring that unpleasant odors do not form in the drawer-type cooling box.

Other features which are considered as characteristic for the invention are set forth in the appended claims.

Although the invention is illustrated and described herein as embodied in a drawer-type cooling box, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
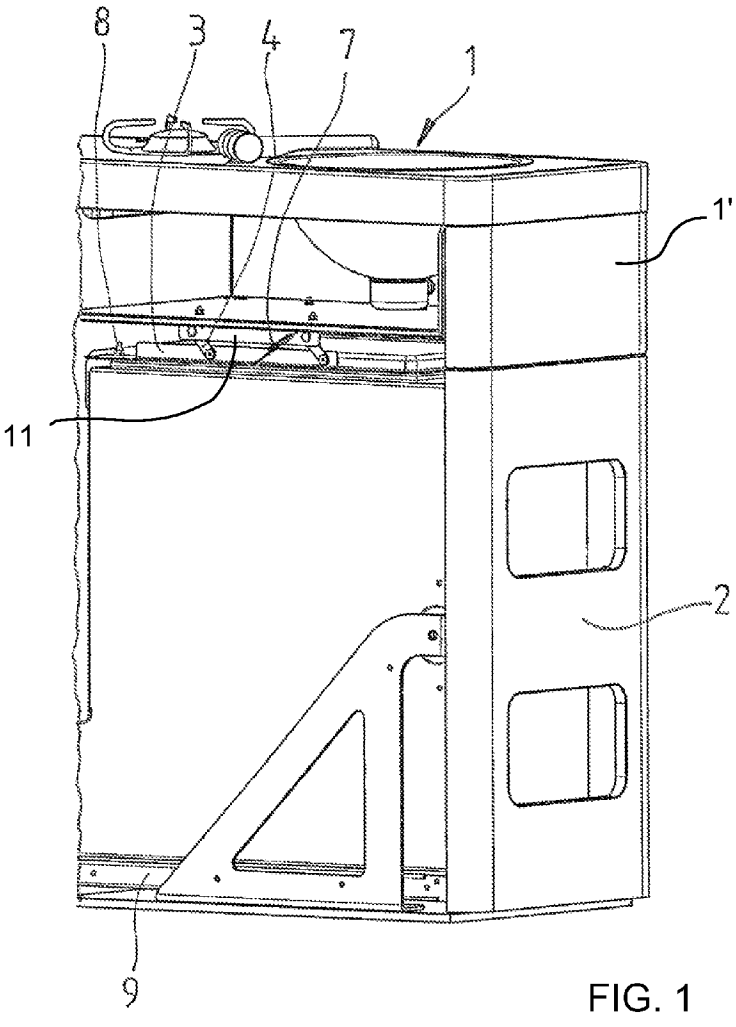
FIG. 1 is a diagrammatic, perspective view of a kitchen unit in partial section according to the invention.
Figure 3:
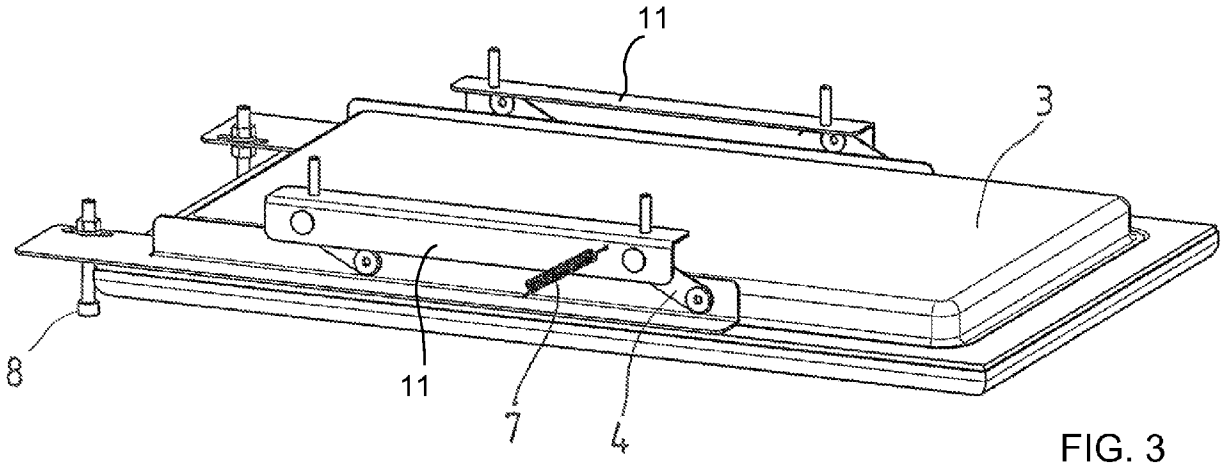
FIG. 3 is a diagrammatic, perspective view of a cooling box covering with a lift-off mechanism.
Figure 4:
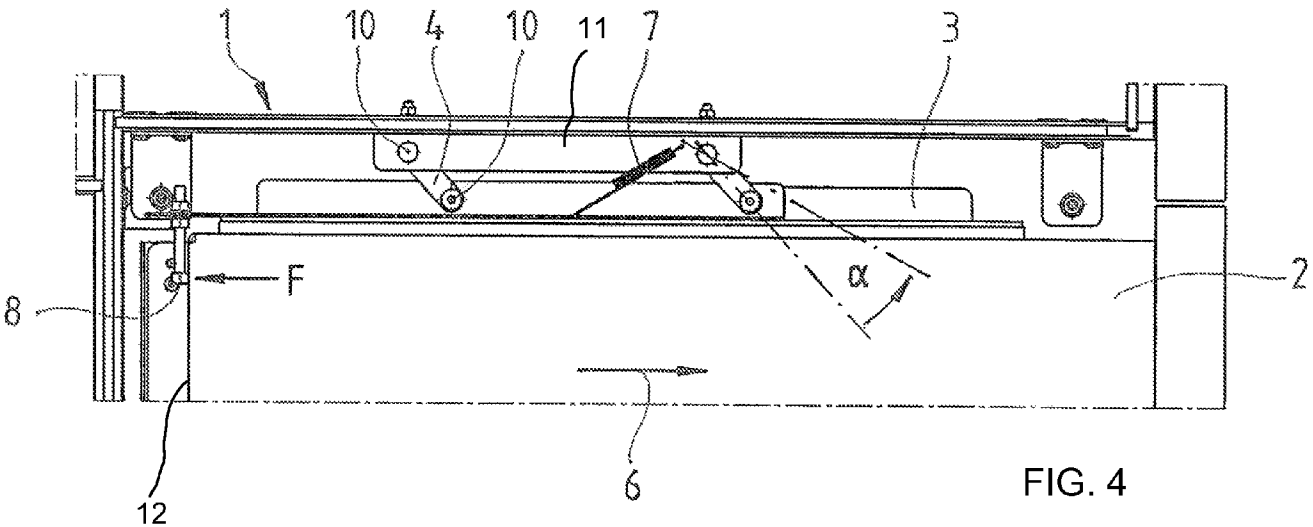
FIG. 4 is a diagrammatic, side view of a pushed-in drawer-type cooling box in partial section.

Referring now to the figures of the drawing in detail and first, particularly, to FIG. 1 thereof, there is shown a drawer-type cooling box containing of a cooling box 2 which is mounted movably in a housing 1' of a kitchen unit 1, wherein the mobility is made possible via longitudinal guides 9 arranged in a base region of the cooling box 2.

Figure 2:
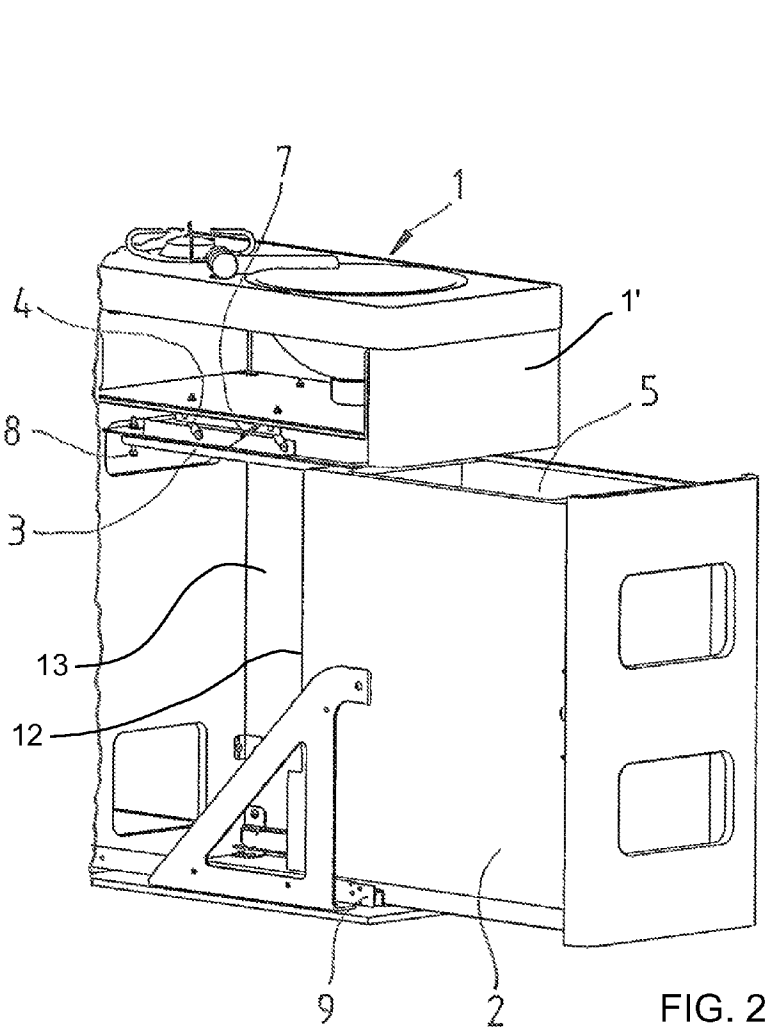
FIG. 2 is a diagrammatic, perspective view of the kitchen unit according to FIG. 1 with a drawer-type cooling box in a pulled out position.

The cooling box 2 has an upwardly directed access opening 5 and a cooling box covering 3 which remains in the housing 1' of the kitchen unit 1 when the cooling box 2 is pulled out as shown in FIG. 2. The cooling box 2 can be moved left or right when viewed from a wide front side 13 of the housing 1'.

The cooling box covering 3 is mounted movably in parallel upward via two double-jointed levers arranged in pairs on both sides thereon and so as to be pivotable about an angle $\alpha$ in the kitchen unit 1, wherein an elastic helical spring 7 is pretensioned between the cooling box covering 3 and a part 11 of the housing 1' on both sides of the cooling box covering 3 and permanently pulls the cooling box covering 3 into a raised position.

In the rear region of the cooling box covering 3, the latter is provided with two downwardly extending drivers 8 which, from the inwardly directed end side of the cooling box 2 from a virtually completely to the completely closed position, are subjected to a closing or shutting force F rotating the coupling elements 4 about the axes of rotation thereof counter to the spring force of the elastic spring element 7 and lowering the cooling box covering 3 downward. A rear end side 12 of the cooling box 2 presses against the drivers 8 in a closed position of the cooling box covering 3.

During a movement of the cooling box 2 to the outside, the drivers 8 follow a small path in which the cooling box covering 3 is moved upward again about the axes of rotation of the coupling elements 4 by the elastic spring element 7, and the access opening 5 of the cooling box 2 is completely open and accessible.

The invention claimed is:

1. A drawer-type cooling box assembly, comprising:

a housing for a kitchen unit of a camping vehicle;

pull-out guides;

coupling elements;

a cooling box mounted in said housing, so as to be able to be pulled out and pushed in on said pull-out guides and having an upwardly directed access opening formed therein and an upper cooling box covering, said cooling box covering mounted to said housing and movably in said housing via said coupling elements, said cooling box covering is lifted off upward from said cooling box in a pulled-out position of said cooling box and, in a pushed-in position, said cooling box is lowered downward onto said access opening of said cooling box; and said coupling elements having double-jointed levers disposed in pairs and on both sides of said cooling box covering and having horizontal axes of rotation at right angles to a pull-out direction.

2. The drawer-type cooling box assembly according to claim 1, wherein said coupling elements are each of identical length, and a parallel movement of said cooling box covering in relation to an upper edge of said access opening of said cooling box is produced.

3. The drawer-type cooling box assembly according to claim 1, further comprising an elastic spring element disposed between said cooling box covering and a part of said housing located thereabove, said elastic spring element keeping said cooling box covering permanently prestressed upward with an elastic spring force.

4. The drawer-type cooling box assembly according to claim 3, further comprising a downwardly extending driver, that side of said cooling box covering which is opposite to a pull-out direction is assigned said downwardly extending driver against which a rear inner end side of said cooling box presses from a virtually completely closed position as far as a closed position and moves said cooling box covering in parallel downward onto said access opening counter to the elastic spring force and keeps said cooling box covering on said cooling box.

5. The drawer-type cooling box assembly according to claim 1, wherein said cooling box is integrated laterally in said housing and is configured so as to be able to be pulled out to a left or right from a wide front side.

6. The drawer-type cooling box assembly according to claim 5, wherein in that at least in the pulled-out position, said cooling box is accessible from within and from outside the camping vehicle.

7. The drawer-type cooling box assembly according to claim 4, wherein in that, when a cooling function is not in use, said downwardly extending driver can be placed out of operation, and said cooling box is configured to be permanently ventilated in a state in which it is pushed into the kitchen unit.

* * * * *